US006755304B2

(12) United States Patent
Ryals

(10) Patent No.: US 6,755,304 B2
(45) Date of Patent: Jun. 29, 2004

(54) SHIPPING CONTAINER FOR ELONGATED ARTICLES

(76) Inventor: Jeffrey Ryals, 935 Manor Dr., Kings Mountain, NC (US) 28086

( * ) Notice: Subject to any disclaimer, the term of this patent is extended or adjusted under 35 U.S.C. 154(b) by 101 days.

(21) Appl. No.: 10/093,759

(22) Filed: Mar. 8, 2002

(65) Prior Publication Data

US 2002/0153275 A1 Oct. 24, 2002

Related U.S. Application Data

(60) Provisional application No. 60/274,136, filed on Mar. 8, 2001.

(51) Int. Cl.[7] ..... B65D 85/20
(52) U.S. Cl. ..... 206/443; 206/523
(58) Field of Search ..... 206/335, 386, 206/443, 523, 592–594, 446

(56) References Cited

U.S. PATENT DOCUMENTS 1,121,232 A * 12/1914 Davis ..... 206/587
3,647,105 A * 3/1972 Keeslar ..... 220/23.4
5,040,678 A * 8/1991 Lenmark et al. ..... 206/443
5,111,938 A * 5/1992 Soprano et al. ..... 206/386
5,131,404 A * 7/1992 Neeley et al. ..... 600/576
5,148,919 A * 9/1992 Rubin ..... 206/443
5,542,535 A * 8/1996 Dalton ..... 206/419
5,553,708 A * 9/1996 Lawrence et al. ..... 206/419
5,881,878 A * 3/1999 Faccioli et al. ..... 206/438
5,882,603 A * 3/1999 Taggart ..... 422/104

* cited by examiner

*Primary Examiner*—Jim Foster
(74) *Attorney, Agent, or Firm*—Baker Botts LLP

(57) ABSTRACT

A shipping container for elongated articles includes (a) a rigid container housing, including a bottom wall and at least one upright side wall enclosing the bottom wall, and having an open upper end for receiving a plurality of elongated articles, (b) a cushioning member supported by at least a portion of the bottom wall, and positioned between the bottom wall and the open upper end, and (c) a plurality of receptacle members, each defining a hollow channel having a lower end and an upper end and being adapted for holding one of the elongated articles, and being positioned with the lower end in proximity to the cushioning member and the upper end in proximity to the open upper end of the rigid container housing, the plurality of receptacle members being stably supported by each other and the at least one side wall of the rigid container housing.

10 Claims, 4 Drawing Sheets

28

SHIPPING CONTAINER FOR ELONGATED ARTICLES

CROSS-REFERENCE TO RELATED APPLICATIONS

This application is based on Provisional Application Serial No. 60/274,136, filed Mar. 8, 2001, which is incorporated herein by reference for all purposes and from which priority is claimed.

BACKGROUND OF THE INVENTION

1. Field of the Invention

The present invention relates to shipping containers, and more particularly, to shipping containers for elongated articles.

2. Description of the Related Art

An important part of the business of a manufacturer is to provide ways of packing and shipping its goods to its customers in a manner that ensures that they are not damaged or marred and allows them to be unloaded easily and quickly. The manufacturer must also be attentive to keeping the costs of shipping materials and of preparing the goods for shipping low, making it as easy as possible to pack and load the goods into containers, and minimizing the use of disposable wrapping materials and containers for its goods.

Gas springs are used for aiding the lifting of loads, such as the tailgates of automotive vehicles. In conventional shipping containers, gas springs have been packed for shipment to vehicle manufacturers (and other customers) horizontally in layers, with foam sheets separating the layers to prevent marring of the individual gas springs. As a rule, the conventional shipping containers have been of a capacity that permits them to be handled manually by both the shipper and the purchaser/end user. Weight limits under worker safety standards have required the use of relatively small containers. The need for foam or other protective material, which is conventionally disposed of, increases the material and labor costs of packing and shipping, generates environmental waste, and requires not only that personnel remove the gas springs but remove and dispose of the protective packing materials. Accordingly, there exists a need in the art for a shipping container which can overcome the aforementioned disadvantages associated with the conventional shipping containers.

SUMMARY OF THE INVENTION

An object of the present invention is to provide a shipping container for elongated articles, such as gas springs, that is economical to fabricate, easy to load and unload, provides excellent protection of the articles, is reusable, and allows the goods to be shipped without any disposable wrapping or packing materials.

This and other objects, which will become apparent with reference to the disclosure herein, are accomplished by a shipping container for elongated articles according to the present invention, which comprises: (a) a rigid container housing, including a bottom wall and at least one upright side wall enclosing the bottom wall, and having an open upper end for receiving a plurality of elongated articles; (b) a cushioning member supported by at least a portion of the bottom wall, and positioned between the bottom wall and the open upper end; and (c) a plurality of receptacle members, each defining a hollow channel having a lower end and an upper end, and being adapted for holding one of the elongated articles, and being positioned with the lower end in proximity to the cushioning member and the upper end in proximity to the open upper end of the rigid container housing, the plurality of receptacle members being stably supported by each other and the at least one side wall of the rigid container housing.

In one embodiment of a shipping container constructed in accordance with the present invention, a protective member is interposed between the cushioning member and the lower ends of the receptacle members to prevent the elongated articles received within the receptacle members from penetrating the cushioning member. Preferably, the protective member includes a plastic sheet, where plastic is used to avoid rusting. The plastic sheet may include one or more drainage holes.

Preferably, the receptacle members are open at both ends, and each of the plurality of receptacle members abuts at least two adjacent receptacle members and is secured thereto to form an interconnected receptacle member unit. The receptacle members in the unit are supported by each other, and the receptacle member unit is supported by the side wall(s), since the receptacle members at the perimeter of the unit abut the side wall(s) of the rigid container housing. The receptacle members in the receptacle member unit are advantageously arranged in a honeycomb pattern.

Advantageously, the receptacle members are of a length such that portions of the elongated articles adjacent their upper ends protrude from the receptacle members for ease of loading and unloading. In other words, each receptacle member has a pre-determined height that is smaller than a pre-determined length of a corresponding elongated article to be inserted therein.

The shipping container, according to the invention, receives the elongated articles in vertical orientations with respect to the bottom of the container, which has the advantage of presenting all of the articles directly at the top. As mentioned above, past practice has involved packing the elongated articles on their sides, which presents only a row of side by side articles at any point of time in the process of unloading. Preferably, each article is received in an individual receptacle member, thus protecting each article from contact with any other article. In most cases, the articles need not be wrapped, inasmuch as the receptacle members provide sufficient protection against marring and damage of the articles by keeping them from contacting each other. The protruding upper parts of the elongated articles facilitate unloading the container by presenting a part of the article that can be grasped by hand or by a machine part.

In a preferred embodiment of the shipping container constructed in accordance with the present invention, the receptacle members are joined to each other, which provides additional stability to the receptacle member unit beyond that derived from having them in mutual contact and, in particular, facilitates unloading individual articles without risk of a loose receptacle member being withdrawn from the container with the elongated article.

In most cases, maximum density for shipping groups of containers dictates that the containers be rectangular in plan and side elevation. Round receptacle members are preferred over other shapes for strength. With rectangular containers and round receptacle members, maximum density of the receptacle members is attained by having them arranged in rows with the longitudinal axes of the receptacle members of each row lying in a plane and by staggering the receptacle members in a honeycomb fashion in which the receptacle members in adjacent rows are offset relative to each other in the direction of the planes of the rows by a distance equal to the outside radius of the receptacle members. The staggered rows, in addition to increasing the density, retain the possibility of easily loading the receptacle members row by row using automated loading equipment.

The cushioning member may be formed of a closed-cell polymeric foam—a closed cell foam does not absorb liquids. A neoprene foam is preferred. The receptacle members may be pieces cut from extrusions of a durable polymeric material, such as PVC.

One advantageous use for a shipping container according to the present invention is for shipping elongated articles such as gas springs and suspension struts, which are generally manufactured by any given manufacturer with cylinders of different diameters. For such uses, the receptacle members may be round and have inner diameters large enough to receive the largest diameter articles made by the manufacturer.

To minimize movements radially of the elongated articles having transverse external dimensions somewhat smaller than the corresponding inner dimensions of the receptacle members, an insert panel may be placed into the rigid container housing. The insert panel overlays the upper ends of the receptacle members and has a plurality of holes extending vertically therethrough. The holes are in vertical alignment with respective ones of the receptacle members such that the elongated articles inserted into the receptacle members extend vertically through the holes. The insert panel is stably supported laterally in the shipping container, preferably by shaping and sizing it so that at least portions of its perimeter engage the side wall(s) of the rigid container housing. The insert panel may rest on an upper end of the receptacle member unit. As previously indicated, the insert panel has holes in a pattern corresponding to the pattern of the receptacle members, centered with respect to the receptacle members, and of a size such as to accept, engage and stably support a portion of the article being shipped. The insert panel may be of a semi-rigid polymeric material, such as a blend of neoprene and nitrile rubber. Such a material provides a cushioning effect so that marring of the elongated articles is avoided.

When the transverse outer dimensions of the elongated articles being shipped are close to the inner dimensions of the receptacle members so that the articles are stably supported by the receptacle members, the insert panel may be omitted, if desired. When, however, the elongated articles are somewhat smaller in size than the inner dimensions of the receptacle members, an insert panel, with holes of a size close to the outer dimensions of the articles at the lengthwise region where the articles are supported by the insert panel, keeps the articles stably supported so that the exposed portions above the receptacle members do not contact each other.

The cushioning member may have holes in a pattern corresponding to the pattern of the receptacle members in the receptacle member unit and of a size smaller than the lower end of the elongated article being shipped. The holes allow drainage of liquids from each receptacle member. In that regard, it is often important, such as in the case of gas springs, in which a protective oil film is present on the rods, to thoroughly wash the containers before loading them.

The shipping container may have guideways under the bottom wall for easier engagement by a forklift truck. Advantageously, the container has a base associated with the bottom wall that nests in an open upper end of another shipping container so that the containers can be stacked in a truck, railcar, or other transport vehicle.

In accordance with the present invention, the objects as described above have been met, and the need in the art for a shipping container for elongated articles that is economical to fabricate, easy to load and unload, provides excellent protection of the articles, is reusable, and allows the goods to be shipped without any disposable wrapping or packing materials, has been satisfied.

DESCRIPTION OF EXEMPLARY EMBODIMENTS

Figure 1:
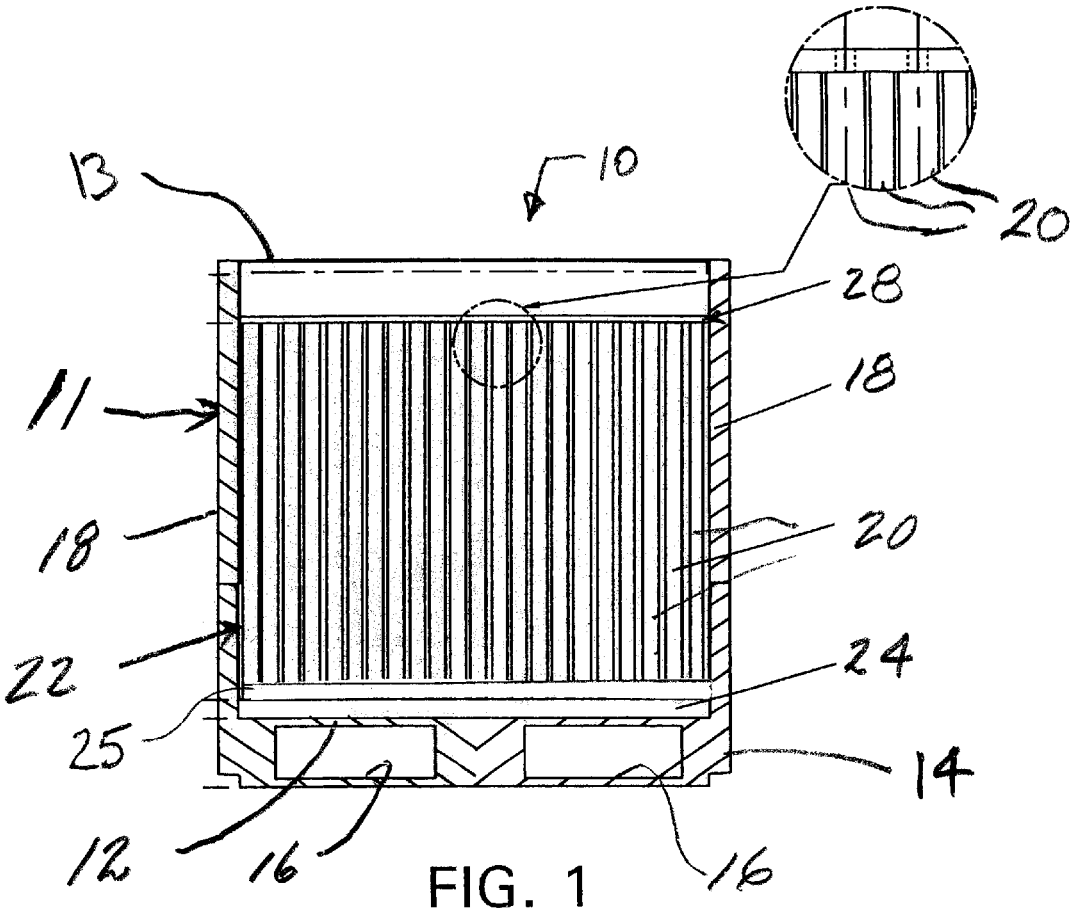
FIG. 1 is a side cross-sectional view of one embodiment of a shipping container according to the present invention.

FIG. 1 is a side cross-sectional view of one embodiment of a shipping container 10 according to the present invention. The shipping container 10 includes a reusable rigid container housing 11 that is commercially available under the trademark "ROPAK" from Linpak Materials Handling of Georgetown, Ky. The rigid container housing 11 has a bottom wall 12 formed by the upper part of a pallet base 14, which includes two-way or four-way forklift guideways 16. As supplied, the ROPAK container housing 11 has collapsible side walls 18 forming an open upper end 13, preferably of rectangular shape in plan and all four side elevations—the collapsible feature is not used. The present invention may use any durable, reusable rigid container housing. Rectangular containers are, of course, preferred for maximum density when loaded in groups into a transport vehicle. The containers are stackable, and top covers (not shown) are available to close the topmost container of a stack.

A cushioning member 24, supported by at least a portion of the bottom wall 12 is positioned between the bottom wall 12 and the open upper end 13. The cushioning member 24 may rest on the bottom wall 12 of the rigid container housing 11 and cushion the bottom wall 12 to protect the bottom ends of the elongated articles. In this case, the cushioning member 24 may be a foam sheet, which may be of a closed cell neoprene foam, e.g., 0.75 inch thick.

Alternatively, a protective member 25 may be interposed between the cushioning member 24 and the lower ends of the receptacle members 20 to prevent the elongated articles received within the receptacle members 20 from penetrating the cushioning member 24. In such a case, the thickness of the cushioning member 24 may be reduced to, e.g., 0.5. inches.

Figure 2:
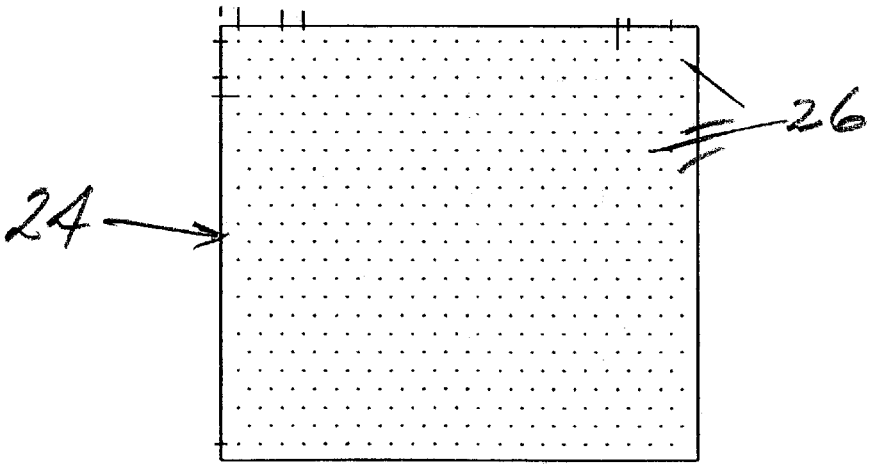
FIG. 2 is a top plan view of a cushioning member of the embodiment of FIG. 1.

Referring to FIG. 2, a top plan view of a cushioning member of the embodiment of FIG. 1 is illustrated. The cushioning member 24 has holes 26 located to register with the lower ends of a plurality of receptacle members 20, to permit liquids to drain from those receptacle members 20. Before a container is reused, it is thoroughly washed to remove oil residues and any contaminants that might stick to the oil and mar the elongated articles.

Referring back to FIG. 1, each receptacle member 20 defines a hollow channel having a lower end and an upper end and is adapted for holding one of the elongated articles. The lower end is positioned in proximity to the cushioning member 24, and the upper end in proximity to the open upper end of the rigid container housing 11. The plurality of receptacle members 20 are stably supported by each other and the side walls of the rigid container housing 11.

Preferably, the rigid container housing 11 is filled with one or more axially straight receptacle members 20 of round cross section, which are identical to each other in size and shape and stand upright relative to the bottom wall 12 of the container. Each of the plurality of receptacle members 20 abuts at least two adjacent receptacle members and is secured thereto, e.g., by bonding with a cement, to form an interconnected receptacle unit 22. Each receptacle member 20 has an inside diameter such as to receive a single elongated article of the largest size to be shipped. For gas springs used in vehicles, which have cylinders that range in outside diameters from a little over ½ inch up to 1-¼ inch, the receptacle members may be 1.25 inch ID and 1.32 inch OD and may be extruded from polyvinyl chloride or some other durable polymeric material.

Figure 3:
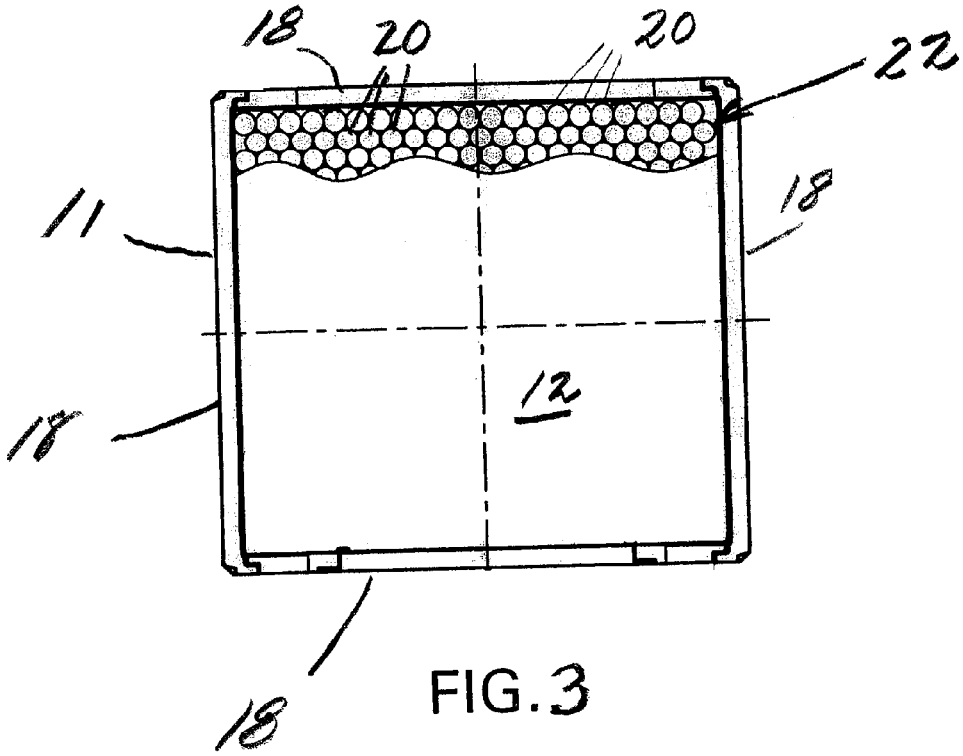
FIG. 3 is a top plan view of the embodiment of FIG. 1, in which a part of the receptacle member unit is broken away.

Referring to FIG. 3, a top plan view of the embodiment of FIG. 1, in which a part of the receptacle member unit is broken away, is illustrated. The receptacle members 20 are arranged in plan in staggered rows in which the center axes of the receptacle members 20 in each row form a plane. The receptacle members of adjacent rows are offset relative to each other by one outside radius in a honeycomb pattern. The perimeter receptacle members are preferably placed directly or indirectly (spacers may be provided if required) in contact with the side walls 18 of the rigid container housing 11.

The interconnection of the receptacle members 20 to form a receptacle member unit 22 ensures that when a worker (or a robot machine) removes an elongated article from a receptacle member 20, the receptacle member 20 is not withdrawn with the elongated article. The receptacle members 20 are of a length less than the overall length of the elongated articles so that a part of each elongated article extends above the top of the receptacle member unit 22 (see FIG. 6). In other words, each receptacle member 20 has a pre-determined height that is smaller than a pre-determined length of a corresponding elongated article to be inserted therein.

When the receptacle members 20 are loaded with elongated articles having cylinders with external diameters less than about 1 inch, the exposed upper portions of the elongated articles (see FIG. 6) can contact each other and cause marring. To prevent such contacts, an insert panel 28 overlaying the upper ends of the receptacle members 20 MAY BE used.

Figure 4:
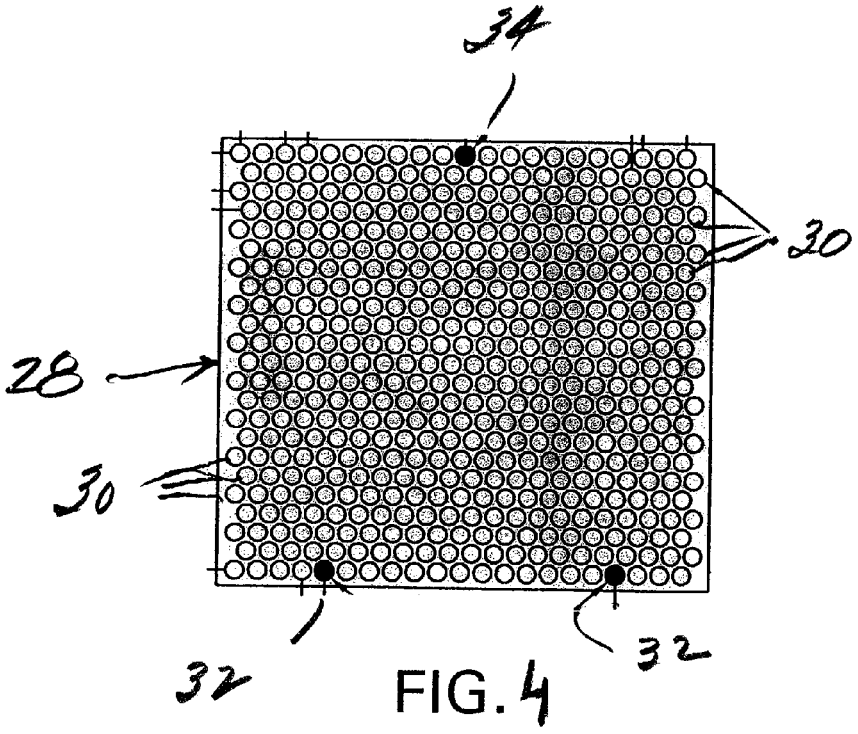
FIG. 4 is a top plan view of an insert panel for use in the embodiment of FIG. 1.

Referring to FIG. 4, a top plan view of an insert panel 28 for use in the embodiment of FIG. 1 is illustrated. The insert panel 28 has a plurality of holes 30 extending vertically therethrough, the holes 30 being in vertical alignment with respective ones of the receptacle members 20 such that the elongated articles inserted into the receptacle members 20 extend vertically through the holes 30. In other words, the holes 30 register with the upper ends of the receptacle members—i.e., a hole 30 corresponds to each receptacle member 20 and is axially centered relative to the receptacle member 20. The holes 30 are of a diameter such that they engage or closely surround and retain the upper end of each elongated article against contact with any adjacent elongated article. Insert panels 28 with holes 30 of different sizes may be inserted into the rigid container housing 11 interchangeably as required for each size or size range of the elongated articles. The insert panels 28 may be made by forming holes in a sheet of a neoprene/nitrile rubber or some other material with a cushioning property that does not mar the elongated articles.

Preferably, hinge members 32, e.g., grommets, are inserted in two holes adjacent one edge of the insert panel 28 for reception of tethering cables (not shown) that attach the insert panel 28 to a side wall 18 of the rigid container housing 11. Another grommet 34 adjacent the side opposite the grommets 32 provides a finger hole by which a worker can, if he or she chooses, pivot the insert panel 28 up in hinged fashion about the tethering cables to facilitate removing the gas springs. If the insert panel 28 remains in place on the receptacle member unit 22, the fittings on the lower ends of the gas springs can catch on the insert panel 28, which can be a nuisance when the gas springs are being removed. The tethering cables prevent the workers from completely removing the insert panels 28 and discarding them. Advantageously, the receptacle members 20 positioned below the hinge members 32 and the grommet 34 have their upper and lower ends closed, to prevent elongated articles from entering the receptacle members. It will be understood that the hinge members 32 and the grommet 34 may be omitted, if desired, in which case the receptacle members 20 located therebelow could receive elongated articles for shipment.

Figure 5:
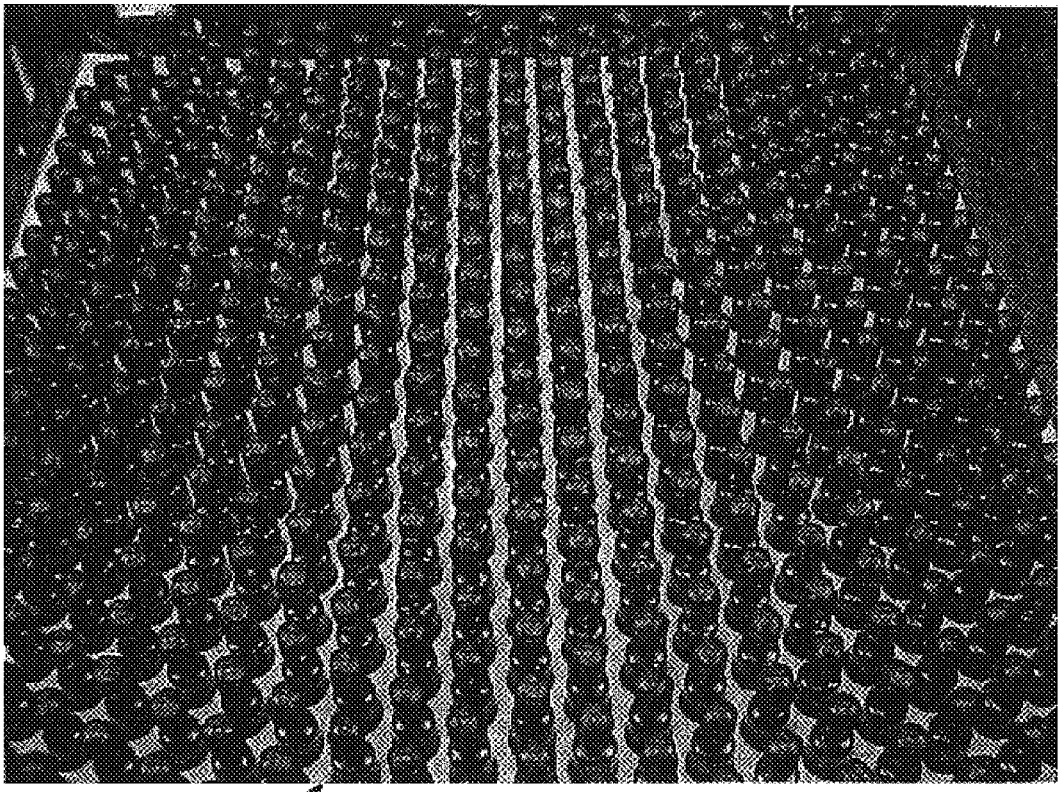
FIG. 5 is a perspective view of the shipping container loaded with gas springs taken from a viewpoint above and to the side.

FIG. 5 illustrates a perspective view of the shipping container 10 loaded with gas springs taken from a view point above and to the side. The gas springs have sufficiently small diameters relative to the diameters of the receptacle members 20, so an insert panel 28 is placed in the rigid container housing 11 to secure the gas springs from contacting each other. This is further illustrated in FIG. 6.

Figure 6:
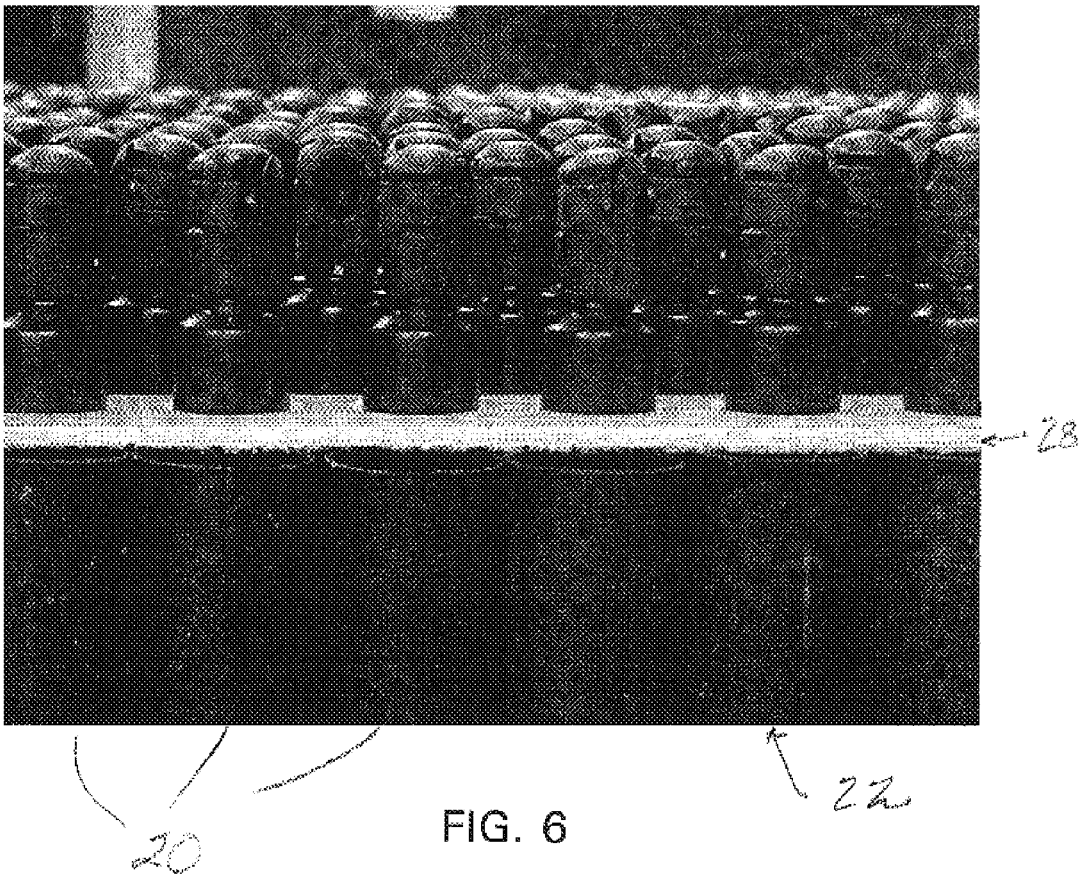
FIG. 6 is a partial side cross-sectional view of the upper portions of gas springs of FIG. 5 and an insert panel.

FIG. 6 is a partial side cross-sectional view of the upper portions of gas springs of FIG. 5 and an insert panel 28. The receptacle members 20 have inner diameters that are larger than the outer diameters of the gas springs. Therefore, the insert panel 28 may be used to overlay the upper ends of the gas springs to prevent any significant movement in a lateral direction. In other words, the insert panel 28 secures the gas springs so as to prevent them from contacting each other.

Thus, there is provided, in accordance with the present invention, a shipping container for elongated articles, such as gas springs, that is economical to fabricate, easy to load and unload, provides excellent protection of the articles, is reusable, and allows the goods to be shipped without any disposable wrapping or packing materials.

Although the invention has been described herein by reference to specific embodiments thereof, it will be understood that such embodiments are susceptible of modification and variation without departing from the invention concepts disclosed. For example, the receptacle members 20 may have different shapes, e.g., conical, etc. The cross-sections of the receptacle members 20 may also be different, e.g., hexagonal, rectangular, etc. All such modifications and variations, therefore, are intended to be included within the spirit and scope of the appended claims.

What is claimed is:

1. A shipping container for elongated articles, comprising:

(a) a rigid container housing, including a bottom wall and at least one upright side wall enclosing said bottom wall, and having an open upper end for receiving a plurality of elongated articles;

(b) a cushioning member supported by at least a portion of said bottom wall, and positioned between said bottom wall and said open upper end;

(c) a plurality of receptacle members, each defining a hollow channel having a lower end and an upper end and being adapted for holding one of said elongated articles, and being positioned with said lower end in proximity to said cushioning member and said upper end in proximity to said open upper end of said rigid container housing, said plurality of receptacle members being stabily supported by each other and said at least one side wall of said rigid container housing; and (d) a protective member interposed between said cushioning member and the lower ends of said receptacle members to prevent the elongated articles received within said receptacle members from penetrating said cushioning member, wherein said protective member comprises a sheet having one or more drainage holes.

2. A shipping container for elongated articles, comprising:

(a) a rigid container housing, including a bottom wall and at least one upright side wall enclosing said bottom wall, and having an open upper end for receiving a plurality of elongated articles;

(b) a cushioning member supported by at least a portion of said bottom wall, and positioned between said bottom wall and said open upper end; and (c) a plurality of receptacle members, each defining a hollow channel having a lower end and an upper end and being adapted for holding one of said elongated articles, and being positioned with said lower end in proximity to said cushioning member and said upper end in proximity to said open upper end of said rigid container housing, said plurality of receptacle members being stably supported by each other and said at least one side wall of said rigid container housing, wherein said cushioning member comprises a closed-cell polymeric foam.

3. The shipping container of claim 2, wherein said closed-cell polymeric foam is a neoprene foam.

4. A shipping container for elongated articles, comprising:

(a) a rigid container housing, including a bottom wall and at least one upright side wall enclosing said bottom wall, and having an open upper end for receiving a plurality of elongated articles;

(b) a cushioning member supported by at least a portion of said bottom wall, and positioned between said bottom wall and said open upper end; and (c) a plurality of receptacle members, each defining a hollow channel having a lower end and an upper end and being adapted for holding one of said elongated articles, and being positioned with said lower end in proximity to said cushioning member and said upper end in proximity to said open upper end of said rigid container housing, said plurality of receptacle members being stably supported by each other and said at least one side wall of said rigid container housing, wherein each of said plurality of receptacle members abuts at least two adjacent receptacle members and is secured thereto to form an interconnected receptacle member unit, wherein said plurality of receptacle members in said receptacle member unit are arranged in a honeycomb pattern.

5. A shipping container for elongated articles, comprising:

(a) a rigid container housing, including a bottom wall and at least one upright side wall enclosing said bottom wall, and having an open upper end for receiving a plurality of elongated articles;

(b) a cushioning member supported by at least a portion of said bottom wall, and positioned between said bottom wall and said open upper end;

(c) a plurality of receptacle members, each defining a hollow channel having a lower end and an upper end and being adapted for holding one of said elongated articles, and being positioned with said lower end in proximity to said cushioning member and said upper end in proximity to said open upper end of said rigid container housing, said plurality of receptacle members being stably supported by each other and said at least one side wall of said rigid container housing, wherein each receptacle member has a pre-determined height that is smaller than a pre-determined length of a corresponding elongated article to be inserted therein; and (d) an insert panel overlaying the upper ends of said receptacle members and having a plurality of holes extending vertically therethrough, said holes being in vertical alignment with respective ones of said receptacle members such that the elongated articles inserted into said receptacle members extend vertically through said holes.

6. The shipping container of claim 5, wherein said insert panel further comprises one or more hinge members for securing said insert panel to at least one side wall of said rigid container housing.

7. The shipping container of claim 5, wherein the holes in said insert panel are sized to restrain movement of the elongated articles radially within the individual receptacle members.

8. The shipping container of claim 7, wherein said insert panel comprises a polymeric material.

9. The shipping container of anyone of claims 1, 2, 4 and 5, wherein said bottom wall comprises a base having a set of guideways adapted to be engaged by a forklift.

10. The shipping container of anyone of claims 1, 2, 4 and 5, wherein said base is adapted to be nested in an open upper end of a second shipping container.

* * * * *